US005686167A

United States Patent [19]

Rudy

[11] Patent Number: 5,686,167

[45] Date of Patent: Nov. 11, 1997

[54] FATIGUE RESISTANT FLUID CONTAINING CUSHIONING DEVICE FOR ARTICLES OF FOOTWEAR

[75] Inventor: Marion Franklin Rudy, Northridge, Calif.

[73] Assignee: Robert C. Bogert, Marina Del Rey, Calif.; a part interest

[21] Appl. No.: 463,494

[22] Filed: Jun. 5, 1995

[51] Int. Cl.[6] ..... B37B 1/00; B37B 3/12; A43B 13/20

[52] U.S. Cl. ..... 428/178; 428/158; 428/159; 428/160; 428/161; 428/163; 428/166; 428/167; 428/168; 428/178; 428/179; 36/29

[58] Field of Search ..... 428/166, 167, 428/168, 158, 159, 160, 161, 163, 178, 179; 36/29

[56] References Cited

U.S. PATENT DOCUMENTS

| | | |
|---|---|---|
| 900,867 | 10/1908 | Miller . |
| 1,145,534 | 7/1915 | Wetmore . |
| 1,193,608 | 8/1916 | Poulson . |
| 1,241,832 | 10/1917 | Druckenmiller . |
| 1,304,915 | 5/1919 | Spinney . |
| 1,498,838 | 3/1924 | Harrison, Jr. . |
| 1,514,468 | 8/1924 | Schopf . |
| 2,074,286 | 12/1937 | Sullivan . |
| 2,080,469 | 5/1937 | Gilbert . |
| 2,100,492 | 10/1937 | Sindler . |
| 2,177,116 | 7/1939 | Persichino . |
| 2,189,813 | 2/1940 | MoGuire . |
| 2,677,906 | 8/1954 | Reed . |
| 2,739,093 | 1/1956 | Bull . |
| 2,762,134 | 7/1956 | Town . |
| 3,005,272 | 6/1961 | Shelare et al. . |
| 3,225,463 | 12/1965 | Burnham . |
| 3,410,004 | 11/1968 | Finn . |
| 3,589,037 | 6/1971 | Gallagher . |
| 3,724,105 | 4/1973 | Weight . |
| 3,760,056 | 9/1973 | Rudy . |
| 3,922,801 | 12/1975 | Zente . |
| 4,100,686 | 7/1978 | Sgarlato et al. . |
| 4,183,156 | 1/1980 | Rudy . |
| 4,219,945 | 9/1980 | Rudy . |
| 4,271,606 | 6/1981 | Rudy ..... 36/29 |
| 4,593,482 | 6/1986 | Mayer . |
| 4,991,317 | 2/1991 | Lakic . |
| 4,999,931 | 3/1991 | Vermeulen . |

*Primary Examiner*—Patrick Ryan
*Assistant Examiner*—R. P. Weisberger
*Attorney, Agent, or Firm*—Fay, Sharpe, Beall, Fagan, Minnich & McKee

[57] ABSTRACT

A structure forming part of a shoe comprising a sealed member of elastomeric material having a plurality of chambers containing a fluid, the chamber having a generally planar alignment, the plurality of chambers interconnected by a plurality of flexible sheets, wherein at least a portion of at least a plurality of the interconnecting sheets is oriented at an angle to the general plane of the chambers.

11 Claims, 5 Drawing Sheets

UNDER COMPRESSION LOAD

NO LOAD

FATIGUE RESISTANT FLUID CONTAINING CUSHIONING DEVICE FOR ARTICLES OF FOOTWEAR

FIELD OF THE INVENTION

This invention relates to cushioning inserts for articles of footwear. More particularly, this invention relates to a fatigue resistant multi-chambered fluid filled insert positioned in the sole of a shoe.

DESCRIPTION OF THE ART

A variety of fluid containing cushioning devices exist. Many of these are short term, low load applications, such as inflatable splints, braces, liners, pillows, neck braces, padding, etc. In a more stressful application, fluid containing cushioning devices are employed in articles of footwear either beneath select parts, or all of the load bearing surface of a foot. In these footwear applications, a cushioning device is subjected to extremely high and generally cyclical loads.

Athletic endeavors, a particular concern of this invention, provide one environment in which high loads are repeatedly encountered. For example, a runner may experience nearly 11,000 incidences of foot strike in a typical 10 kilometer run. Since it is desirable that a cushion insert maintain a high level of shock absorbance for several years of use, a cushioning device preferably withstands millions of shock absorbing cycles.

An exceptional medium meeting these cushioning requirements is a fluid, preferably a compressible fluid. Moreover, a fluid has inherent mechanical longevity which generally does not degrade over time. Particularly, to the extent an encapsulation member retains the fluid, the compressive characteristics of the fluid will continue to cushion the foot at nearly 100% of its initial capabilities. This contrasts with materials such as foam, another frequently employed footwear cushioning material, which degrades over time from collapse of the cellular structure.

Accordingly, it can be seen that maintaining the integrity of the material encasing the fluid is of critical importance. Although this suggests building an encasement member from a sturdy and bulky barrier material, it should be understood that sturdy and bulky barrier materials may overshadow the cushioning activity of the fluid contained therein. Particularly, in addition to the inherent longevity of a fluid, cushioning mediums which rely on fluids are believed to provide superior cushioning characteristics (shock absorbance, distribution, and energy return) than a solid medium. Therefore, if the walls of the material encasing the fluid are too thick, or if a material having too high of a modulus of elasticity is used, the walls of the chamber, rather than the fluid contained therein, control the cushioning function. In this event, the desirable and beneficial rapid redistribution and cushioning of force via dynamic pressure changes and fluid movement, the transient storage of otherwise damaging shock/impact energy, the efficient return of energy to the wearer, and the longevity of a fluids compressive characteristics are significantly lost to the unfavorable barrier member characteristics. Hence, it is desirable to have a fluid containing cushioning device, wherein the barrier envelope does not detract from the desired long-lived dynamic fluid characteristics, and which allows the fluid to act relatively independently yet maintains its structural integrity for a long period of time.

Much work in the field of fluid filled cushions has involved construction of plastic encasement members filled with a gas. Often, the plastic member comprises a foot sole shaped body having top and bottom layers sealed at the periphery. U.S. Pat. No. 4,991,317, for example, describes an inflatable sole for a shoe formed of plastic sheets bonded by a continuous seam about the peripheral edges. A plurality of seams are also formed between the plastic sheets within the sealed interior of the inflatable sole to form a plurality of interconnected tubular passages. It is believed that the internal and peripheral seams are the weakest points in this construction. Moreover, failures are most likely to occur at these points where the seam forming process reduces the strength of the plastic. In addition, the reduced strength in the seams of the plastic is compounded by the cushion's tendency to preferentially fold and bend at the seams during use. When subjected to cyclical loading, the repeated folding and bending along the seams and weld areas and the associated stress concentration and stress reversals, can cause fatigue failure of the plastic sheet forming the chambers.

One manner of increasing the fatigue resistance of a fluid filled cushioning device having a plurality of chambers is discussed in U.S. Pat. No. 4,219,945, wherein a pneumatic, multichambered insert comprised of an elastomeric material filled with a large molecule gas is encased or encapsulated in elastomeric foam. The foam fills in the external surface irregularities of the inflated cushion and prevents sharp bends and folds from developing in the elastomeric material, particularly in the weakest areas adjacent the welds, when compressed under a load. It has been found that this design extends the life of the cushioning device and, in fact, resulted in a very commercially successful shoe.

Notwithstanding the success of this design, the cost of shoe production can be reduced, the ease of production can be increased, the cushioning characteristics can be improved, the life extended, and overall weight reduced if an elastomeric fluid containing cushioning device can be designed with an improved elastomeric material structure which reduces undesirable bending and folding.

SUMMARY OF THE INVENTION

In accordance with the purpose of the invention as embodied and broadly described herein, the fluid containing cushioning device of this invention comprises a sealed member of elastomeric material extending generally along a plane and having a plurality of fluid filled chambers with at least some of the chambers in fluid communication. Adjacent chambers are connected by uninflated elastomeric material and at least a portion of each interconnecting region is oriented at an angle to the generally planar orientation of the sealed member.

When the cushioning device of the subject invention is compressed under a load, the interconnecting uninflated elastomeric material influences and controls the shape into which the chambers of the sealed member are compressed, thusly, damaging sharp bends and folds in the elastomeric material forming the chambers is reduced. Moreover, the subject invention achieves a predetermined and controlled, rather than random, folding of individual chambers under load. In this manner, the weld areas and even the chamber walls experience significantly reduced sharp folding. Accordingly, the foam encapsulation of the cushion is further improved or made unnecessary.

An advantage of the present invention is to provide a cushioning device for articles of footwear comprised of multi-chambered fluid filled elastomeric material wherein the individual chambers are interconnected in a manner which reduces folding and bending stresses on the cushion under loaded conditions. This allows a long-lived cushioning device to be built, in which predominantly the mechanics of the fluid absorb and disperse the forces of impact.

Alternatively described, the preferred cushion is comprised of a plurality of adjacent chambers having of an uninflated region forming an interconnecting web which is oriented at an angle to a line passing between the center points of adjacent chambers. The controlled and uniform manner of cushion folding which is achieved by this design reduces fatigue stresses. Particularly, the interface of the web uninflated elastomeric connecting material with the chamber walls, often a weld point, is typically a weak region and is typically the location of folding in prior cushion designs. In this invention, the design of the web minimizes and controls the contortion at this interface while causing the chambers to spread and roll upon themselves to support these areas. Accordingly, stress in the joint/weld interfaces is minimized and fatigue life and durability of the inflated cushioning device is increased.

While the current invention is particularly preferred as a cushion in footwear without foam encapsulation, its encapsulation in foam to further reduce stress on the elastomeric material and/or create a more uniform surface is considered within the scope of the invention.

BRIEF DESCRIPTION OF THE DRAWINGS

The invention consists of the novel parts, construction, arrangements, combinations and improvements shown and described. The accompanying drawings, which are incorporated in and constitute a part of the specification illustrate the invention and, together with the description, serve to explain the principles of the invention.

Of the drawings.

DETAILED DESCRIPTION OF THE PREFERRED EMBODIMENT

Reference will now be made in detail to the present preferred embodiment of the invention, an example of which is illustrated in the accompanying drawings. While the invention will be described in connection with the preferred embodiment, it will be understood that it is not intended to limit the invention to that embodiment. On the contrary, it is intended to cover all alternatives, modifications and equivalents as may be included within the spirit and scope of the invention defined by the appended claims.

Figure 1:
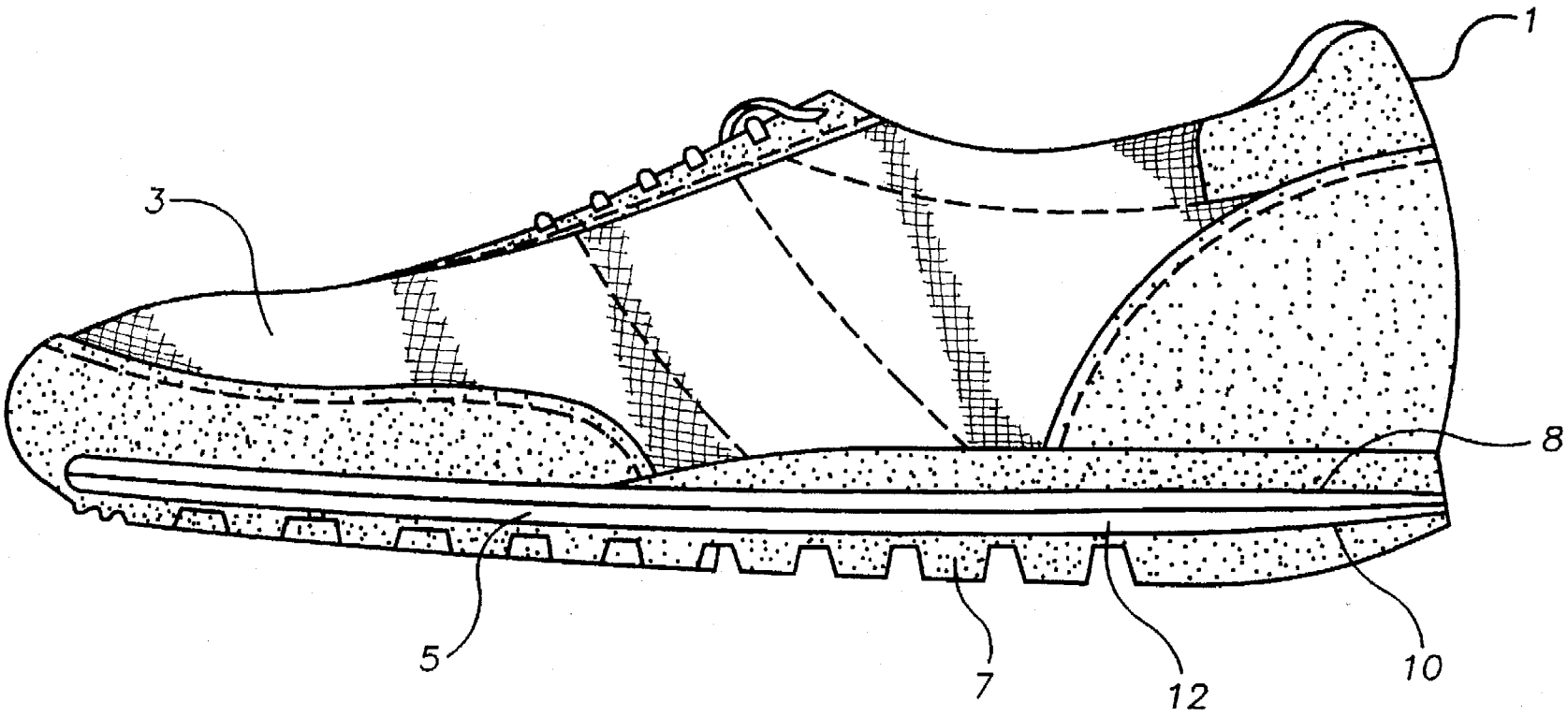
FIG. 1 is a side elevational view of a shoe incorporating a cushioning device in accordance with the present invention.
Figure 2:
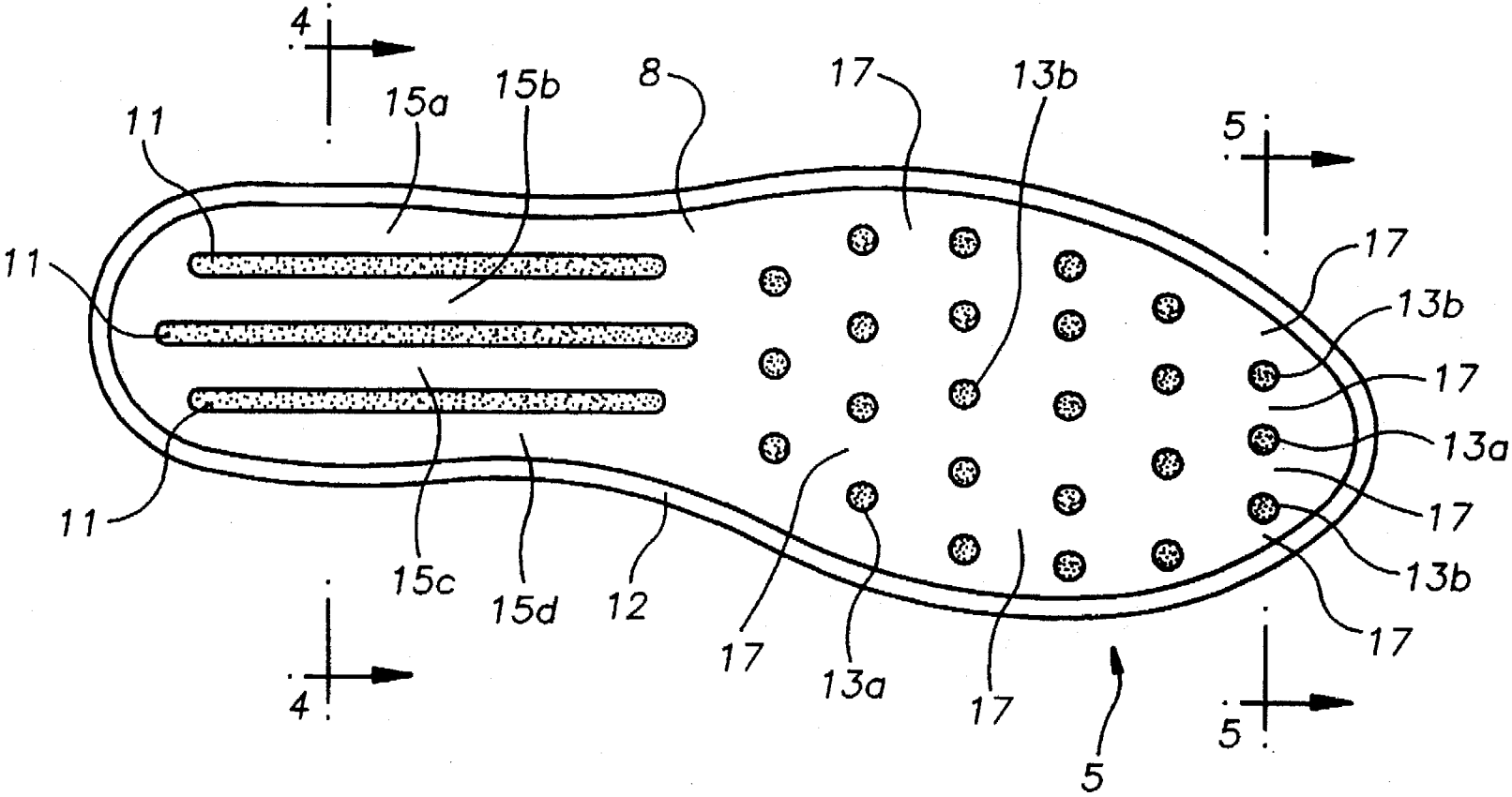
FIG. 2 is a top plan view of the cushion of FIG. 1 which may be used as a shoe insole, midsole or outsole or any combination thereof.

Referring now to FIGS. 1 and 2, it may be seen that the shoe 1 comprises an upper 3, constructed of leather, nylon or any other material known to those skilled in the art, secured to a cushion insert 5 and an outsole 7, serving as a ground engaging portion of the shoe. Midsole 5 is comprised of an elastomeric material having two or more chambers (for example 15*a*, 15*b*, 15*c*, 15*d*, and 17), at least some interconnecting. If an outsole is omitted from the shoe, the inflated insert forming the mid-sole can also function as the outsole and engage the ground or other surface on which the shoe is used.

The chambers are formed by weld lines 11 and weld spots 13. Particularly, the inflated insert comprises two or more layers, a top layer 8 and a bottom layer 10, each comprised of a thin, elastomeric material whose outer perimeter 12 is sealed in a shape to conform to the human foot or a portion thereof. Preferably, the outer perimeter and the weld lines and spots are sealed thermally, adhesively, ultrasonically, with a solvent, or by any other technique known to those skilled in the art.

Accordingly, the fluid-filled cushion insert 5 is comprised of two layers of elastomeric material sealed or welded together at the periphery 12 and along weld lines 11 or weld spots 13 to form a multiplicity of interconnecting chambers or compartments 15 and 17, respectively. As recognized by those skilled in the art, the chambered design functions to provide a stable cushion. The weld lines and weld spots interconnecting the plurality of chambers are generally referred to herein as the "web" of the cushioning insert 5.

In a preferred embodiment, the fluid-filled elastomeric member includes a heel area comprised of intercommunicating longitudinal chambers 15 and a forefoot area comprised of a plurality of generally diamond-shaped chambers 17. Of course, the entire cushion can be comprised of longitudinal chambers, diamond shaped chambers, or any other effective shape only limited by the positioning of the welds and the skill of the cushion designer.

The material forming the cushioning insert is selected to be relatively impermeable to diffusion of the fluid contained therein, thus creating a fluid barrier to prevent escape of the fluid or gas from the chambers. Examples of preferred materials include polyurethane, polyester elastomer, fluoroelastomer, chlorinated polyethylene, polyvinylchloride, chloral sulfonated polyethylene, polyethylene/ethylene vinyl acetate copolymer, neoprene, butadiene acrylonitrile rubber, butadiene styrene rubber, ethylene propylene polymer, natural rubber, high strength silicon rubber, low density polyethylene, adduct rubber, sulfide rubber, methyl rubber, thermoplastic rubbers, high nitrite rubber, halogenated butyl rubber, polyurethane-polyethylene glycol adipate, and blends thereof. Of the above materials, polyurethane film has been found to be a particularly desirable cushioning insert material.

The insert may be filled with the following exemplary but non-limiting fluids and gasses or combinations thereof. water, gels, foams, semi-gel liquids, oils, grease, soft or liquid wax, glycerine, soft soap, silicones, rheopexic fluids, thixotropic fluids, corn syrups, air, or the following "super" gasses: hexafluoroethane, sulfur hexafluoride, perfluoropropane, perfluorobutane, perfluoropentane, perfluorohexane, perfluoroheptane, octafluorocyclobutane, perfluorocylobutane, hexafluoropropylene, tetrafluoromethane, monochloropentafluoroethane, 1,2-dichlorotetrafluoroethane, 1,1,2-trichloro-1,2,2-trifluoroethane, chlorotrifluoroethylene, bromotrifluoromethane, monochlorotrifluoromethane, and nitrogen. Particularly preferred within these groups are hexafluoroethane, sulfur hexafluoride, nitrogen, air, and combinations thereof.

Preferably, the insert is inflated by injecting therein, the special non-polar large molecule, inert "super" gas with low solubility coefficient. This may be performed by puncturing one of the chambers with a hollow needle through which the inflating gas is introduced until the desired pressure in the chambers is reached, after which the needle is withdrawn and the puncture formed by it sealed. Alternatively, a valve can be built into the cushion and the cushion pressurized by a pump. The inflation medium may be the large molecule gas alone, or a mixture of the gas and air, or air alone, although it is preferred to use a large molecule gas in combination with air, which can inflate via diffusion pumping or by initially pressurizing the chamber(s) to a preferred pressure or a combination thereof.

Figure 3A:
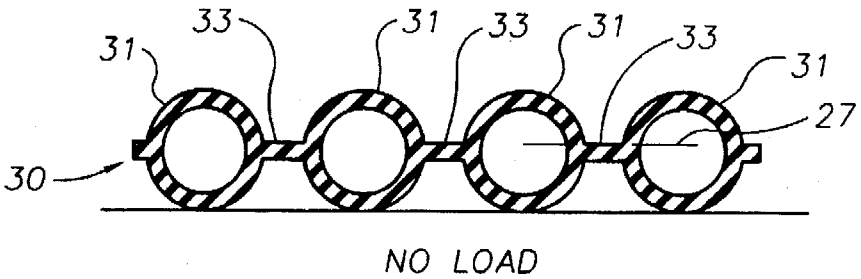
FIG. 3A PRIOR ART
FIG. 3A is a cross-sectional view, taken along a perspective similar line 4—4 of FIG. 2, of a prior art cushioning device.
Figure 3B:
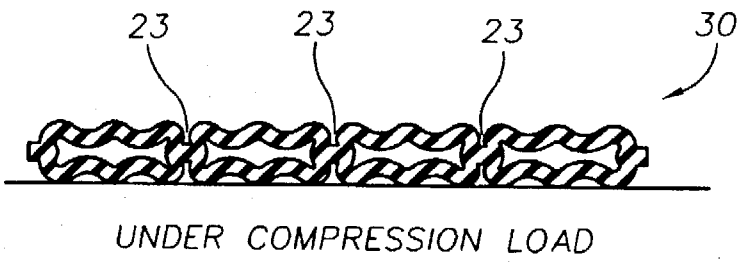
FIG. 3B PRIOR ART
FIG. 3B is the cross-sectional view FIG. 3A in a loaded condition.

Referring now to FIGS. 3A and 3B, the prior art elastomeric cushion device 30 can be seen. In this design, shown in a zero load condition, the chambers 31 are interconnected with a web 33, lying parallel to the plane of the cushion and parallel to a line 27 drawn between the center of adjacent chambers. As seen in FIG. 3B, compression of cushion device 30 under a load shows sharp folding/bending at the interference of the elastomeric material with adjacent chambers at weld points 23. Accordingly, the generally weakest point of the cushion undergoes the greatest and most extreme and damaging repetitive stress reversals.

Figure 4A:
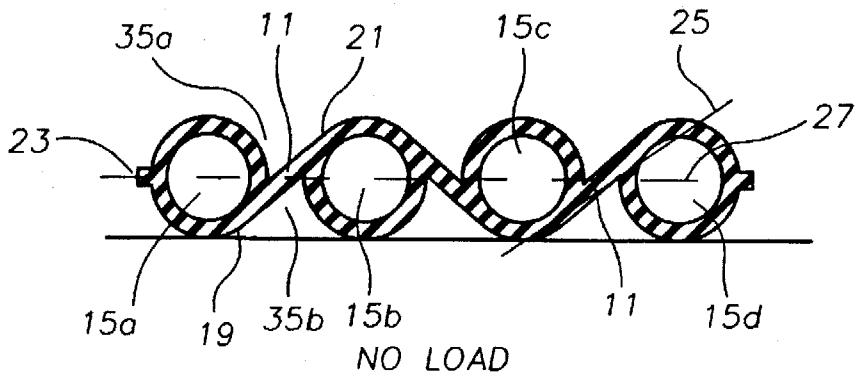
FIG. 4A is a cross-sectional view taken along line 4—4 of FIG. 2.
Figure 4B:
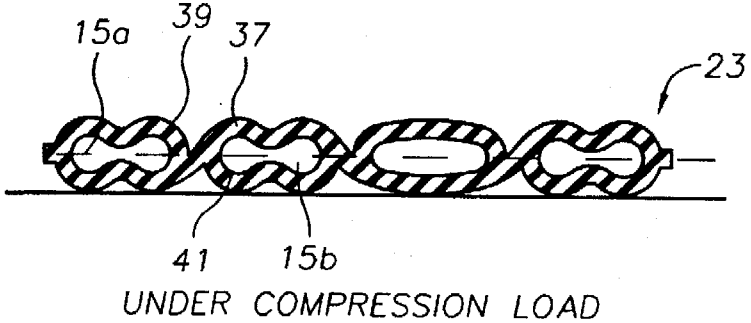
FIG. 4B is the cross-sectional view of FIG. 4A in a loaded condition.

Referring now to FIGS. 4A and 4B, demonstrating the subject invention, the web material 11 interconnects the cushion chambers 15 in a serpentine type of pattern. Moreover, the web extends from a base weld point 19 of one chamber to a upper weld point 21 of an adjacent chamber. Under load, this angled or inclined interconnecting web facilitates an asymmetrical folding pattern of each chamber so as to accommodate and not conflict with the complimentary folding of the adjacent chambers. Particularly, the web urges opposed sections of the adjacent chambers into the void areas 35 between chambers. Moreover, the web 11, connecting points 19 and 21, pulls the upper corner 37 of chamber **15*b* downward allowing the upper corner 39 of chamber 15*a* to roll into a first void 35*a* while the lower corner 41 of chamber 15*b* slides into a second void 35*b***. This results in chambers filling the void areas by expanding and rolling over one another, minimizing the multiple sharp folding/bending at the weld points characteristic of earlier inflated products. This inventive web design therefore provides a life extending integral support to the cushion as the cushion begins to bottom-out.

Figure 5A:
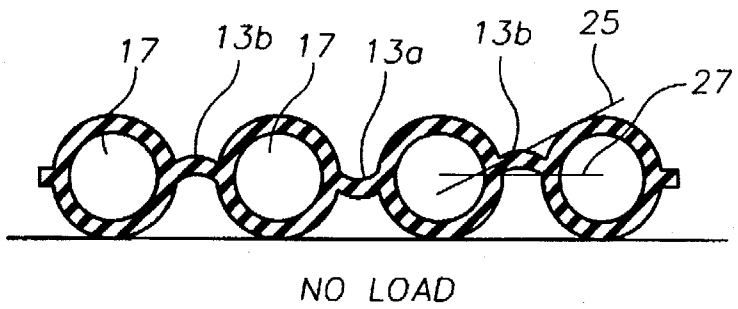
FIGS. 5A and 5B are cross-sectional views taken along line 5—5 of FIG. 2 demonstrating an alternative form of the inventive web in unloaded and loaded conditions, respectively; and, FIGS. 6A and 6B through 7A and 7B are cross-sectional views of alternative embodiments of the invention in unloaded and loaded conditions, respectively.
Figure 5B:
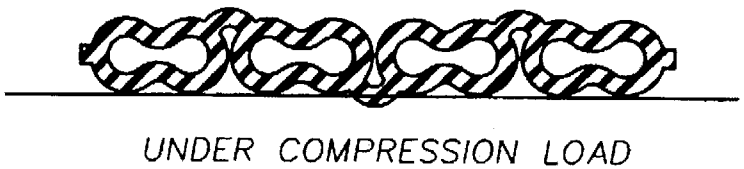
Figure 6A:
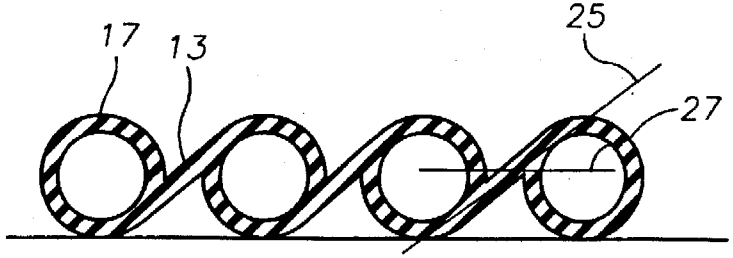
Figure 6B:
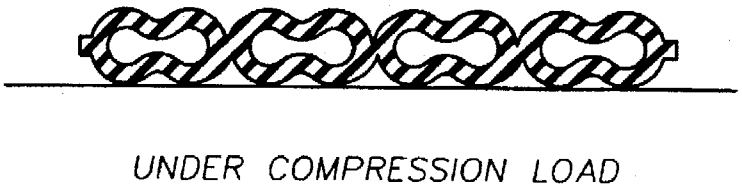
Figure 7B:
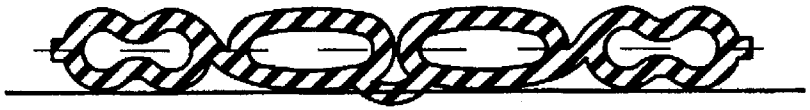
Figure 7A:
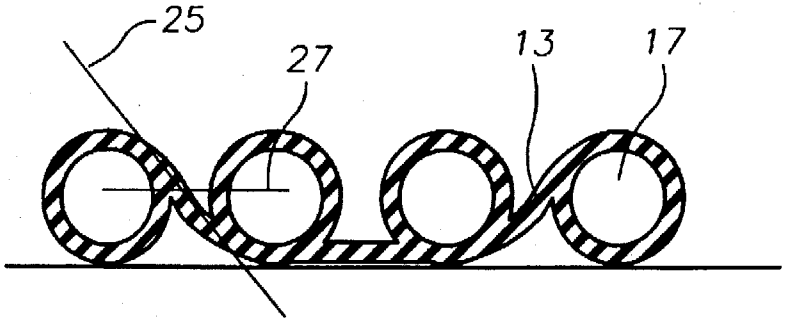

Referring now to the alternative web embodiments shown in FIGS. 5–7, it can be seen that the configured web of the current invention facilitates the flattening and self-accommodating folding action of the adjacent chambers within the cushioning insert in a non-contoured self-supporting manner.

Particularly, in contrast to the prior art chambers in FIG. 3B wherein folding occurs at the interface of the web 23 with the individual chambers, the design of the current invention reduces sharp bends and stress concentrations; and, if they occur, they occur either in non-weld point areas or in a supported region.

Referring again to FIGS. 5–7, alternative forms of the invention are depicted. Importantly, the web 13 interconnecting chambers 17 has a portion oriented at an angle to the plane 23 of the chambers 17, represented by lines 25 and 27, respectively.

While the current invention is intended to function as a possible replacement for a foam encapsulated inflated cushioning device, it does not exclude the incorporation of a foam encapsulation where beneficial. Moreover, it may be desirable for comfort reasons and to slow the immediate rebound effect of pressurized fluid by encasing the top and/or bottom surface of the cushion in an elastomeric material. Elastomeric foam materials which may be utilized may include polyetherurethane, polyesterurethane, ethylvinyl acetate/polyethylene copolymer, polyester elastomer, ethylene vinyl acetate/polypropylene copolymer, polyethylene, polypropylene, neoprene, natural rubber, dacron/polyester, polyvinylchloride, thermoplastic rubber, nitrile rubber, butyl rubber, halogenated butyl rubber, sulfide rubber, polyvinylacetate, methyl rubber, buna-n, buna-s, polystyrene, ethylene propylene, polybutadiene, polypropylene, silicon rubber. As a result of the reduction in stress in the inventive cushion, the preferred elastomeric material will be between 0.001" and 0.045" in thickness.

It should be understood by those of skill in the art that a variety of footwear cushion designs can incorporate the design of the current invention. Moreover, a variety of air cushions can be designed including the angled web to alleviate stress at weld points between the chambers of the cushion. Many of these designs and inventions are described in U.S. Pat. Nos. 3,005,272; 3,685,176; 3,760,056; 4,183,156; 4,217,705; 4,219,945; 4,271,706; 4,287,250; 4,297,797; 4,340,626; 4,370,754; 4,471,538; 4,486,901; 4,506,460; 4,724,627; 4,779,359; 4,817,304; 4,829,682; 4,864,737; 4,864,738; 4,906,502; 4,936,029; 5,042,176; 5,083,361; 5,097,607; 5,155,927; 5,228,217; 5,235,715; 5,245,766; 5,283,963; and, 5,315,769, each of which is herein incorporated by reference.

The current invention achieves several important and beneficial advantages in fluid filled footwear cushioning. First, its can function without foam encapsulation which reduces manufacturing costs and the weight of the final cushioning product. Second, the technical merit of the cushion is improved as the result of elimination of the mitigating effect the foam encapsulation has on the cushioning process. Third, elimination of the encapsulating foam improves the point of sale appeal of the footwear because of the enhanced customer visibility of the high technology cushioning product. Fourth, the resiliency and cushioning characteristics of the invention, particularly dynamic cushioning, are significantly improved. Moreover, the highly sluggish visoelastic encapsulating foam is not present to alter the exceptional instantaneous shock absorption characteristics of a contained and/or pressurized fluid. Fifth, the cushion can be combined with the prior art foam encapsulation technology to produce an even more durable and longer-lived cushioning insert.

Thus, it is apparent that there has been provided in accordance with the invention, a cushioning device for an article of footwear that fully satisfies the objects, aims, and advantages set forth above. While the invention has been described in conjunction with specific embodiments thereof, it is evident that many alternatives, modifications, and variations would be apparent to those skilled in the art in light of the foregoing description. Accordingly, it is intended to embrace all such alternatives, modifications, and variations as fall within the spirit and broad scope of the appended claims.

What is claimed is:

1. A cushion structure forming part of a shoe comprising a sealed member of elastomeric material having a plurality of chambers containing a fluid, said plurality of chambers interconnected by uninflated flexible elastomeric sheets, wherein at least several of said interconnecting sheets are oriented at an angle when no load is applied to the cushion to a line passing between a center point of adjacent chambers.

2. The structure of claim 1 further comprising an elastomeric yieldable outer member encapsulating said structure, said outer member having an upper surface spaced above the chambers.

3. The structure of claim 1 wherein said angled flexible sheets form a generally serpentine pattern extending from a bottom portion of one chamber to a top portion of an adjacent chamber.

4. The structure of claim 1 wherein at least two of said plurality of chambers are in fluid communication with one another.

5. A structure as defined in claim 1 wherein said chambers are inflated with a large molecule gas, air, or mixtures thereof.

6. A structure as defined in claim 5, wherein said gas is either hexafluoroethane; sulfur hexafluoride; perfluoropropane; perfluorobutane; perfluoropentane; perfluorohexane; perfluoroheptane; octafluorocyclobutane; perfluorocyclobutane; hexafluoropropylene; tetrafluoromethane; monochloropentafluoroethane; 1,2-dichlorotetrafluoroethane; 1,1,2-trichloro-1,2,2 trifluoroethane; chlorotrifluorethylene; bromotrifluoromethane; monochlorotrifluoromethane; nitrogen; or mixtures thereof.

7. A structure as defined in claim 1, wherein said elastomeric material is either of: polyurethane; polyester elastomer; fluoroelastomer; chlorinated polyethylene; polyvinyl chloride; chlorosulfonated polyethylene; polyethylene/ethylene vinyl acetate copolymer; neoprene; butadiene acrylonitrile rubber; butadiene styrene rubber; ethylene propylene polymer; natural rubber; high strength silicone rubber; low density polyethylene; adduct rubber; sulfide rubber; methyl rubber; thermoplastic rubber; high nitrile rubber; halogenated butyl rubber; polyurethane-polyethylene glycol adipate blend; or mixtures thereof.

8. A structure as defined in claim 7, wherein said elastomeric material is polyurethane.

9. The structure of claim 1 wherein said uninflated elastomeric region is substantially non-planar.

10. The structure of claim 1 wherein said fluid is selected from the group consisting of water, gels, foams, semi-gel liquids, oils, grease, soft or liquid wax, glycerine, soft soap, silicones, rheopexic fluids, thixotropic fluids, corn syrup, or mixtures thereof.

11. A cushion structure forming part of a shoe comprising a sealed member of elastomeric material having a plurality of fluid filled chambers and uninflated elastomeric material regions interconnecting adjacent chambers, at least several of said elastomeric material regions have a first portion connected to a bottom half of a first adjacent chamber and a second portion connected to a top half of a second adjacent chamber.

* * * * *